United States Patent [19]

Bohn et al.

[11] Patent Number: 4,655,688

[45] Date of Patent: Apr. 7, 1987

[54] CONTROL FOR LIQUID RING VACUUM PUMPS

[75] Inventors: Heinz Bohn, Rullstorf; Werner Fink; Reinhold Luhmann, both of Bardowick, all of Fed. Rep. of Germany

[73] Assignee: ITT Industries, Inc., New York, N.Y.

[21] Appl. No.: 739,553

[22] Filed: May 30, 1985

[30] Foreign Application Priority Data

May 30, 1984 [DE] Fed. Rep. of Germany ..... 3420144

[51] Int. Cl.[4] ..... F04B 49/00; F04C 19/00

[52] U.S. Cl. ..... 417/18; 417/45; 417/68; 417/5

[58] Field of Search ..... 417/68, 69, 18, 32, 417/44, 45, 54

[56] References Cited

U.S. PATENT DOCUMENTS

| | | | |
|---|---|---|---|
| 1,681,574 | 8/1928 | Farmer | 418/84 |
| 1,867,813 | 7/1932 | Easton | 417/68 |
| 2,230,405 | 2/1941 | Jennings | 417/68 X |
| 2,971,691 | 2/1961 | Lorenz | 417/69 |
| 3,981,618 | 9/1976 | Nelson, Jr. | 417/12 |
| 4,087,208 | 5/1978 | Uda et al. | 417/68 X |
| 4,151,725 | 5/1979 | Kountz et al. | 417/32 X |
| 4,225,288 | 9/1980 | Mugele et al. | 417/69 X |
| 4,336,001 | 6/1982 | Andrew et al. | 417/63 |

FOREIGN PATENT DOCUMENTS

| | | | |
|---|---|---|---|
| 697264 | 10/1940 | Fed. Rep. of Germany | 417/68 |
| 968232 | 1/1958 | Fed. Rep. of Germany | 417/68 |
| 2511334 | 9/1976 | Fed. Rep. of Germany | 417/68 |
| 3213155 | 10/1983 | Fed. Rep. of Germany . | |
| 548693 | 10/1922 | France | 417/68 |
| 949275 | 2/1949 | France | 417/68 |
| 2180332 | 11/1973 | France | 417/68 |
| 2077951 | 10/1981 | United Kingdom . | |

OTHER PUBLICATIONS

*Siemens Zeitschrift*, vol. 44, Jun. 1970, pp. 387–392.

*Primary Examiner*—Carlton R. Croyle
*Assistant Examiner*—Paul F. Neils
*Attorney, Agent, or Firm*—Donald J. Lenkszus

[57] ABSTRACT

A closed loop control is provided to control pressure and/or temperature in a system where one or more liquid ring vacuum pumps evacuate a recipient. The suction ability of the liquid ring vacuum pumps is controlled either by speed control, operating water temperature, switching-on and -off of pumps or bypass-air. Simultaneous control of all operating characteristics is achieved with a programmable electronic controller.

42 Claims, 2 Drawing Figures

CONTROL FOR LIQUID RING VACUUM PUMPS

BACKGROUND OF THE INVENTION

The invention pertains to a control system for liquid ring vacuum pumps or the like.

The suction ability of a liquid ring vacuum pump depends on the operating liquid. Where water is used as the operating liquid the suction ability of the vacuum pump can be influenced to a significant extent by adjusting the temperature of the water. In particular at high vacuum levels, the lower the temperature of the operating liquid, the better the results. Therefore cooling the circulating operating liquid is necessary. When water is used as the operating liquid, cooling is normally done by removing part of the heated liquid from the operating liquid circuit and replacing it with cool, fresh liquid from the supply line. Accordingly, the operation of a water-ring vacuum pump can consume considerable amounts of fresh water which thereby affects the operating costs.

In utilizing liquid ring vacuum pumps in a process control system it is necessary to measure certain parameters and control certain variable characteristics. In particular it is necessary to control the output variable parameters of the pumps such as capacities, pump pressures, etc. Control in the past has been accomplished by turning pumps on and off, by adjustment of throttling valves or other control devices.

Because these types of controls are usually associated with significant maintenance and energy costs, it has previously been proposed to achieve the control tasks in modern plants on centrifugal and piston pumps by utilizing stepless or continuous control of a pump's rotative speed. Energy consumption is thereby minimized.

SUMMARY OF THE INVENTION

In accordance with the principles of the invention a control arrangement is provided for vacuum systems which utilize stepless pump speed control and in particular is adapted for use with liquid ring vacuum pumps.

A closed loop control is provided for controlling pressure and/or temperature in a system where one or more liquid ring vacuum pumps evacuates a recipient. The suction ability of the liquid ring vacuum pump or pumps is controlled either by speed control, operating water temperature, switching pumps on and off or by air bleeding.

In accordance with the invention, sensors are connected in the control loop of a pumping system. Measurements obtained from the sensors are applied to a control device having one or more inputs and outputs. The control device includes chronological and logical functions stored in a programmable controller by which control of the rotating speed or power output of one or more pump motors is achieved. With appropriate sensors connected in the control loop, control can be provided to minimize fresh water requirements, provide constant or temporarily variable suction pressure, preventing cavitation, control the maximum motor output power, or control the on and off condition of several pumps.

When a separator is not used in the fresh water pipe, an adjustable bypass valve and line may be used in conjunction with a switching valve to minimize the amount of fresh water required.

To provide control under conditions of constant or temporarily variable suction pressure the liquid ring temperature should be varied within defined operating limits. In this case a pressure sensor, which is adjustable to constant suction pressure can be installed in the suction (vacuum) pipe of the pump or pumps. This sensor is connected to the pump motors through a control device. A speed controller is installed in this control device to guarantee the minimum speed of the electric motor to insure the stability of the liquid ring. The control device must have a frequency limit to prevent mechanical overloading of the pump. Further in accordance with the invention, an air inlet with a switching-valve may be arranged in the suction pipe of the pumps. The switching valve is adjustable to a regulated air input in the suction pipe to prevent cavitation in dependence of the temperature in the exhaust air pipe or in the separator, respectively, as well as the pressure in the suction pipe, by a control device according to a given pressure limit characteristic.

Still further in accordance with the invention, a power input sensor can also be installed in the current lead of the vacuum pump driving motor to continually control the driving motor so that through the control device and the speed controller the motor always achieves its nominal power output.

BRIEF DESCRIPTION OF THE DRAWING

The invention will be better understood from a reading of the following detailed description in conjunction with the drawing in which.

DETAILED DESCRIPTION

Figure 1:
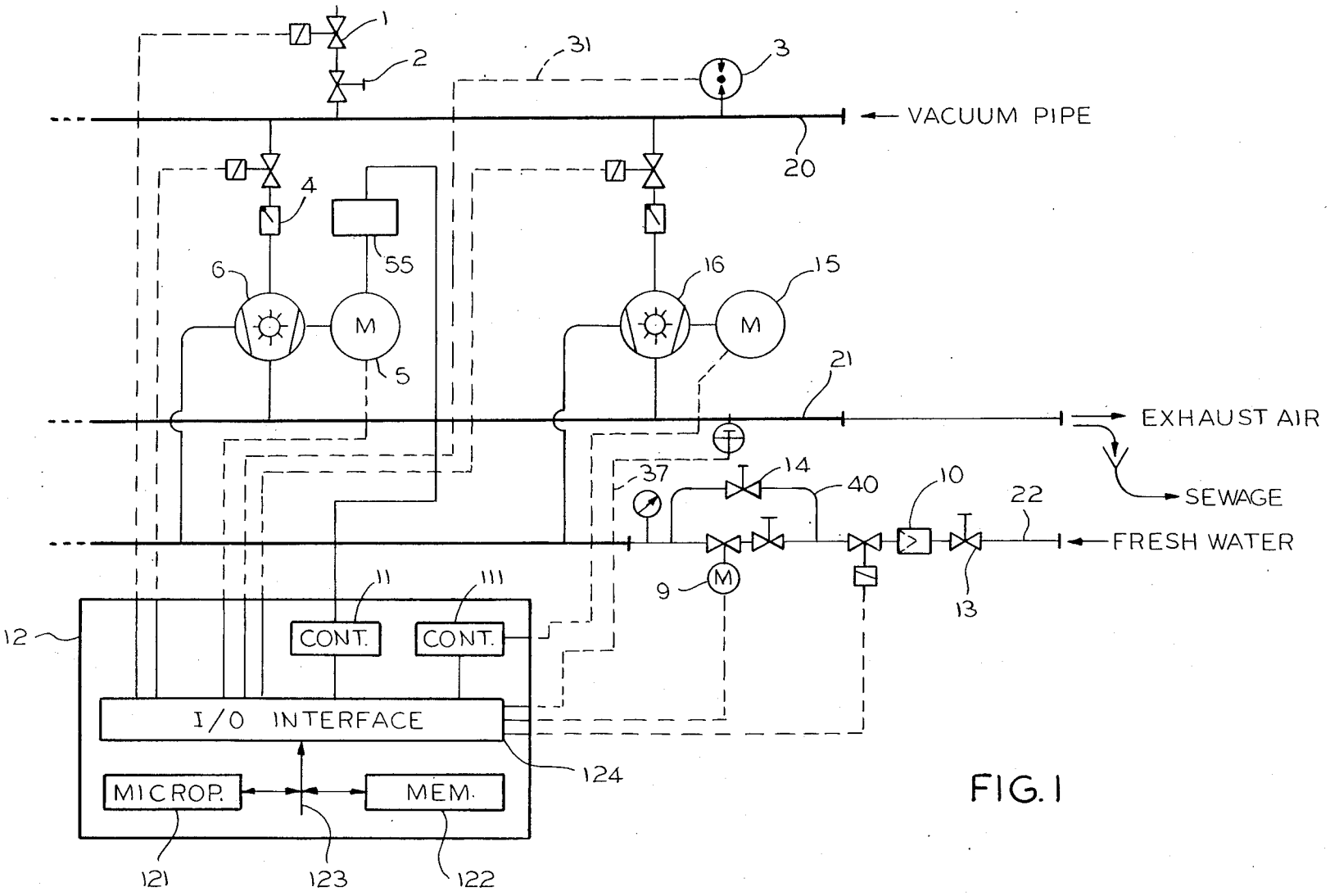
FIG. 1 illustrates in schematic form a vacuum-system with liquid ring vacuum pumps without a separator.
Figure 2:
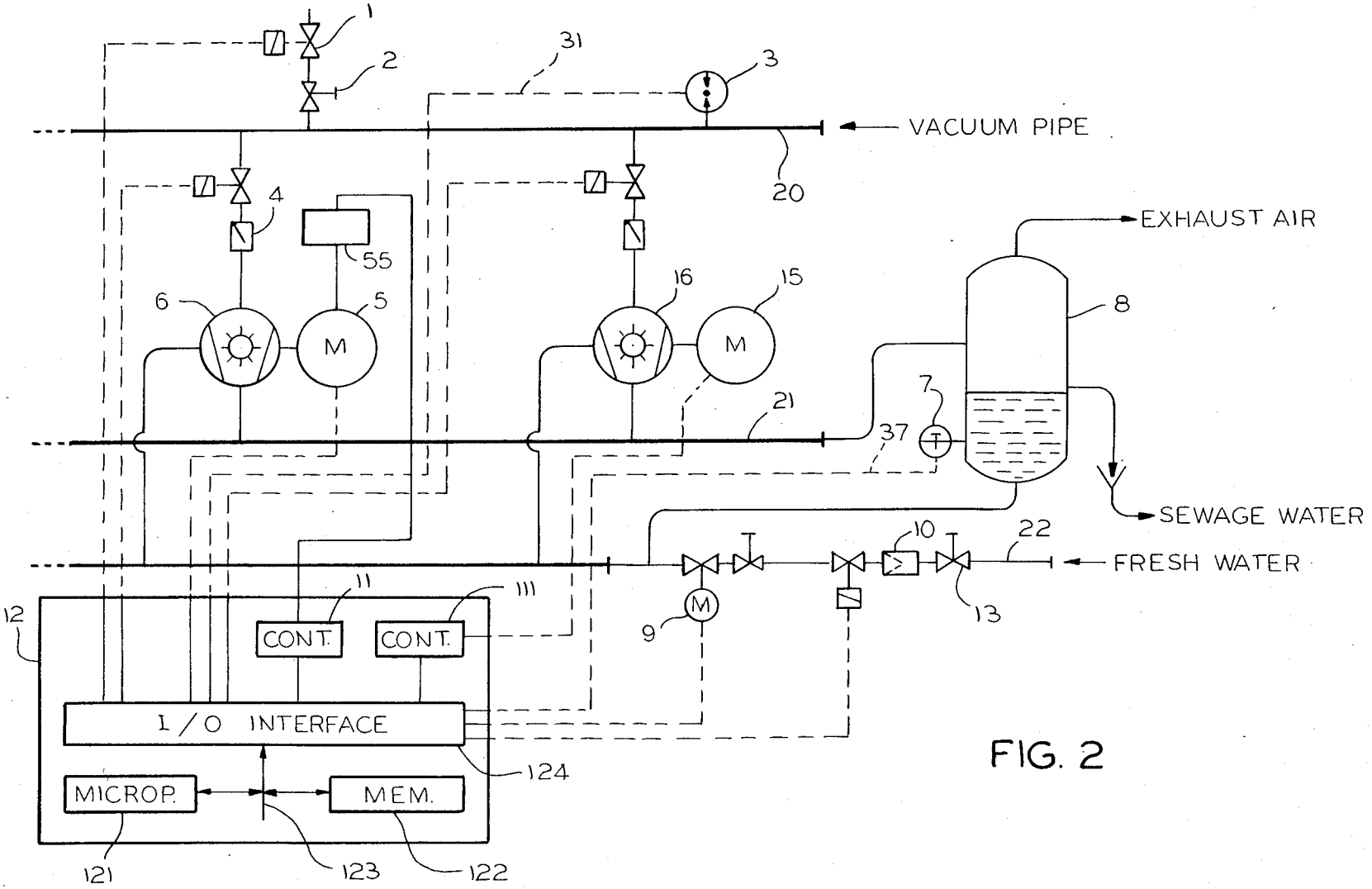
FIG. 2 illustrates in schematic form a vacuum-system with a separator.

The systems of FIGS. 1 and 2 include liquid ring vacuum pumps 6, 16 connected between a suction or vacuum line or pipe 20 and an exhaust air line or pipe 21. Each vacuum pump 6, 16 is driven by an electric motor 5, 15. Although two liquid ring vacuum pumps are shown, the present invention is applicable to systems having only one or more than two liquid ring vacuum pumps.

A source of fresh water is supplied to the liquid ring vacuum pumps via fresh water line 22.

A cutoff valve 13 and a contamination filter 10 are inserted in the water line 22.

A control device 12 has input connections to various sensors to measure corresponding parameters in the system and has output connections to various parts of the system to control variable characteristics of the system. The control device 12 may be a programmable controller with functions stored therein, i.e., it may be a microprocessor controlled apparatus.

For example, the controller may utilize a microprocessor such as Texas Instruments TMS 9995. More specifically, controller 12 may comprise a standard microprocessor-memory-I/O interface configuration as is well known in the electronic arts. The microprocessor 121 communicates with the I/O interface and the memory 122 via its I/O bus 123. The memory 122 may include a read only memory portion containing the programs for the microprocessor and a random access memory portion for storing of data.

Among the sensors shown is a pressure sensor 3 connected in the suction line 20. Electrical connections 31 are provided between the sensor 3 and control device 12. a temperature sensor 7 is connected in the exhaust air line 21 of FIG. 1 or in the separator 8 of FIG. 2 and has electrical connections 37 to the control in the electrical supply line to the motor 5. A power sensor 55 is connected in the current lead of motor 5. Only one power sensor 55 is shown although a power sensor can also be provided for each and every motor used in the system. The power sensor may be any one of the commercially available power sensors such as the GTU 0281 through GTU 0290 series of power sensors available from Metrawatt GMBH, Nuernberg, Germany described in "Mesumformer fur Wirkleistung fur Blindleistung GTU 0281 bis GTU 0290, Technische Daten", Ausgabe 1.84, Ersetzt Ausgabe 3.83.

A speed controller 11 is controlled by the control device 12 to establish the speed of rotation of the motor 5. A similar speed controller 111 establishes the speed of rotation of motor 15. Additional speed controllers may be provided for any additional motors.

The speed controllers may be any of the commercially available static frequency converters. Static frequency converters which are suitable for use in the present invention are available from Danfoss Inc., Mahwah, N.J. and are identified as static frequency converters VLT Types 101 to 104, 205 to 210 and 215 to 230. The selection of the type depends on the size of the pump motor and supply voltage. Such devices are described in "Instructions VLT 215-220-230", Danfoss, 4/83, page 12. A static frequency converter is a unit that electronically converts the fixed voltage and frequency of the main supply to infinitely variable values. This makes it possible to control the speed or torque of standard three phase induction or squirrel cage motors without significant loss of output.

In the fresh water line 22 an electrically controlled valve 9 is provided which has electrical connections to the control device 12 and over which control signals are sent from the control device 12 to control the supply of fresh water to the liquid ring vacuum pumps 6, 16. In the structure of FIG. 1, a bypass line 40 is connected around the valve 9. A valve 14 is provided in bypass line 40 and is adjustable so that a minimum quantity of fresh water is supplied to the liquid ring vacuum pumps regardless of the operative state of valve 9.

An electrically controlled valve 1 is connected to the suction or vacuum line 20 and is controlled via electrical connections to the control device 12. Valve 1 is used as an air bleed control valve to control the amount of air bleed into the suction or vacuum line 20.

Each of the liquid ring vacuum pumps is connected to the suction or vacuum line 20 via a throttle valve 4 which is electrically controlled by the control device 12.

As those skilled in the art will appreciate, the operation of systems utilizing liquid ring vacuum pumps is unique because of the number of highly interrelated characteristics of operation that they have.

The three basic measurements and operative characteristics are (a) the sensing of suction by the pressure sensor 3 and the control of the amount of air bleed into the system by valve 1; (b) the sensing of the water temperature by temperature sensor 7 and the control of the fresh water supplied to the pumps via electrically activated flow valve 9; and (c) sensing the power supplied to the motor and via sensor 55 and optimizing the energy effectiveness by decreasing the motor speed to the minimum at which the liquid ring breaks.

The control device 12 includes stored algorithms or characteristic curves so that water temperature, suction pressure and motor speed may be simultaneously set. Control device 12 will simultaneously: provide control to minimize fresh water consumption, control the suction pressure, prevent cavitation in the liquid ring and control the motor power input.

To minimize fresh water consumption in the structure of FIG. 1 in which a separator is not used, the fresh water supply to the vacuum pump or pumps 6 is adjusted by the by-pass valve 14 so that a minimum quantity is delivered to maintain the water ring. By way of the control system (the temperature sensor 7 in the exhaust air pipe, which is set proportional to the water ring temperature, the control device 12 as well as the control valve 9, the fresh water quantity can be controlled through the control of exhaust air temperature. The higher the exhaust air temperature is set, the less fresh water is required.

Where a separator is used as in FIG. 2, the water temperature in the separator 8 will be kept constant by the control device 12 and the control valve 9 which are adjusted to a constant temperature by the temperature sensor 9.

In multi-pump-operation whether a separator is used or not, there are no additional controls necessary in the water storage pipe.

Control of constant or temporarily variable suction pressure is achieved as follows:

In the vacuum pipe in FIGS. 1 and 2 a pressure sensor 3 is installed in the controlled circuit, consisting of the control device 12, the electric motors 5, 15 and the liquid ring vacuum pumps 6. This control circuit guarantees that a constant suction pressure will be maintained through the vacuum pipe independent of the gas input.

By means of a given temporary suction pressure any pressure/time-diagrams can be developed. By setting a minimum speed at the speed control 11 it is insured that the water ring remains stable. By setting a maximum frequency it is insured that the mechanical load capability of the vacuum pump will not be exceeded. Both the minimum speed and the maximum frequency may be stored in the control device 12.

To prevent cavitation in the liquid ring, in FIGS. 1 and 2 the valve 1 is controlled by the control device 12 independently of the temperature in the exhaust air pipe 7 as well as the pressure in the vacuum pipe 3 so that a given suction pressure limit will be reached independently of the temperature.

The electric capacity sensor 55 in FIGS. 1 and 2 in connection with the control device 12, and by means of the speed control 11 insures the motor 5 will always be driven at its nominal power output.

Furthermore, control device 12 can automatically switch pumps (motors) on and off.

Therefore, a pump control system to switch pumps on in the event of power surges or to switch operation from one pump to another to achieve balanced pump operation of several pumps is provided.

What is claimed is:

1. A control system comprising:

a suction line;

an exhaust line;

a fresh liquid line;

a liquid ring vacuum pump having a suction input coupled to said suction line, an exhaust output coupled to said exhaust line, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensor signals generated by said one or more sensors to control the rotating speed and or power output of said motor and for controlling said regulating devices; and wherein:

the temperature of the liquid ring in said pump is varied within predetermined operating limits stored in said programmable controller to control suction pressure in said suction line.

2. A control system in accordance with claim 1 wherein:

one of said sensors comprises a power input sensors connected in the current leads to said motor and supplying power signals to said control device;

said system comprises a speed controller for varying the speed of said motor; and said control device is responsive to said power signals for controlling said speed controller so that said motor is always run at a predetermined nominal output.

3. A control system in accordance with claim 1 wherein:

one of said sensors comprises a pressure sensor installed in said suction line and providing pressure dependent electrical signals to said control device.

4. A control system in accordance with claim 3 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

5. A control system in accordance with claim 3 wherein:

said control device including speed control means coupled to said motor to vary the rotative speed of said motor in response to said control device, said control device providing signals to said speed control means to regulate the speed of said motor whereby the motor is operated at the minimum speed necessary to insure the stability of the liquid ring.

6. A control system in accordance with claim 5 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

7. A control system in accordance with claim 6 wherein:

said speed control means vary the speed of said motor by varying the frequency of the electrical signals applied thereto;

said control device has stored therein frequency range limitations which prevents overloading of said pump.

8. A control system in accordance with claim 7 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

9. A control system comprising:

a suction line;

an exhaust line;

a fresh liquid line;

a liquid ring vacuum pump having a suction input coupled to said suction line, an exhaust output coupled to said exhaust line, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices; and wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

10. A control system comprising:

a suction line;

an exhaust line;

a fresh liquid line;

a liquid ring vacuum pump having a suction input coupled to said suction line, an exhaust output coupled to said exhaust line, a liquid input coupled to said fresh liquid line;

a motor mechanically driving said pump;

one or more sensors connected in said system to measure predetermined parameters within said system including a temperature sensor installed in said exhaust line;

one or more regulating devices connected in said system to vary one or more respective operative characteristics of said system including an electically actuable first valve in said fresh liquid line;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said one or more regulating devices;

said control system being operative to minimize fresh liquid consumption by said pump; and wherein the temperature of the liquid ring in said pump is varied within predetermined operating limits stored in said programmable controller to control suction pressure in said suction line.

11. A control system in accordance with claim 10 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

12. A control system in accordance with claim 10 wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

13. A control system in accordance with claim 12 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

14. A control system in accordance with claim 10 wherein:

one of said sensors comprises a pressure sensor installed in said suction line and providing pressure dependent electrical signals to said control device.

15. A control system in accordance with claim 14 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

16. A control system in accordance with claim 14 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

17. A control system in accordance with claim 14 wherein:

said control device including speed control means coupled to said motor to vary the rotative speed of said motor in response to said control device, said control device providing signals to said speed control means to regulate the speed of said motor whereby the motor is operated at the minimum speed necessary to insure the stability of the liquid ring.

18. A control system in accordance with claim 17 wherein:

said speed control means vary the speed of said motor by varying the frequency of the electrical signals applied thereto;

said control device has stored their frequency range limitations which prevents overloading of said pump.

19. A control system comprising:

a suction line;

an exhaust line;

a fresh liquid line;

a liquid ring vacuum pump having a suction input coupled to said suction line, an exhaust output coupled to said exhaust line, a liquid input coupled to said fresh liquid line;

a motor mechanically driving said pump;

one or more sensors connected in said system to measure predetermined parameters within said system including a temperature sensor installed in said exhaust line;

one or more regulating devices connected in said system to vary one or more respective operative characteristics of said system including an electrically actuable first valve in said fresh liquid line;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices; and wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

20. A control system in accordance with claim 19 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

21. A control system comprising:

a suction line;

an exhaust line;

a fresh liquid line;

a liquid ring vacuum pump having a suction input coupled to said suction line, an exhaust output coupled to said exhaust line, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices; and wherein:

one of said sensors comprises a power input sensor connected in the current leads to said motor and supplying power signals to said control device;

said system comprises a speed controller for varying the speed of said motor;

said control device is responsive to said power signals for controlling said speed controller so that said motor is always run at a predetermined nominal output; and one of said regulating devices comprises an electrically actuable second valve connected in said suction line, said second valve being controlled by said control device to bleed on into said suction line in accordance with a predetermined pressure limit to regulate air input in said suction line to prevent cavitation in the liquid ring in dependence on the temperature in said exhaust line and pressure in said suction line.

22. A control system comprising:

a suction line;

a separator;

a fresh liquid line;

a liquid ring vacuum pump having a suction input coupled to said suction line, an exhaust output coupled to said separator, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices; and wherein the temperature of the liquid ring in said pump is varied within predetermined operating limits stored in said programmable controller to control suction pressure in said suction line.

23. A control system in accordance with claim 22 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

24. A control system in accordance with claim 22 wherein:

one of said sensors comprises a pressure sensor installed in said suction line and providing pressure dependent electrical signals to said control device.

25. A control system in accordance with claim 24 wherein:

one of said sensors comprises a power input sensor connected in the current leads to said motor and supplying power signals to said control device;

said system comprises a speed controller for varying the speed of saidmotor; and said control device is responsive to said power signals for controlling said speed controller so that said motor is always run at a predetermined nominal output.

26. A control system in accordance with claim 24 wherein:

said control device including speed control means coupled to said motor to vary the rotative speed of said motor in response to said control device, said control device providing signals to said speed control means to regulate the speed of said motor whereby the motor is operated at the minimum speed necessary to insure the stability of the liquid ring.

27. A control system in accordance with claim 26 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

28. A control system in accordance with claim 26 wherein:

said speed control means vary the speed of said motor by varying the frequency of the electrical signals applied thereto;

said control device has stored therein frequency range limitations which prevents overloading of said pump.

29. A control system in accordance with claim 28 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

30. A control system comprising:

a suction line;

a separator;

a fresh liquid line;

a liquid ring vacuum pump having a suction input coupled to said suction line, an exhaust output coupled to said separator, a liquid input coupled to said fresh liquid line;

a motor mechanically driving said pump;

one or more sensors conected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices; and wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

31. A control system comprising:

a suction line;

a separator;

a fresh liquid line;

a liquid ring vacuum pump having a suction input coupled to said suction line, an exhaust output coupled to said separator, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controling said regulating devices;

one of said sensors comprises a temperature sensor installed in said separator;

one of said regulating devices comprises an electrically actuable first vale in said fresh liquid line;

said control system being operative to minimize fresh liquid consumption by said pump; and wherein the temperature of the liquid ring in said pump is varied within predetermined operating limits stored in said programmable controller to control suction pressure in said suction line.

32. A control system in accordance with claim 31 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

33. A control system in accordance with claim 31 wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

34. A control system in accordance with claim 33 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

35. A control system in accordance with claim 31 wherein:

one of said sensors comprises a pressure sensor installed in said suction line and providing pressure dependent electrical signals to said control device.

36. A control system in accordance with claim 35 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

37. A control system in accordance with claim 35 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

38. A control system in accordance with claim 37 wherein:

said control device including speed control means coupled to said motor to vary the rotative speed of said motor in response to said control device, said control device providing signals to said speed control means to regulate the speed of said motor whereby the motor is operated at the minimum speed necessary to insure the stability of the liquid ring.

39. A control system in accordance with claim 38 wherein:

said speed control means vary the speed of said motor by varying the frequency of the electrical signals applied thereto;

said control device has stored their frequency range limitations which prevents overloading of said pump.

40. A control system comprising:

a suction line;

a separator;

a fresh liquid line;

a liquid ring vacuum pump having a suction input coupled to said suction line, an exhaust output coupled to said separator, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals operated by said one or more sensors to control the rotating speed and or power output of said motor and for controlling said regulating devices;

one of said sensors comprises a temperature sensor installed in said separator;

one of said regulating devices comprises an electrically actuable first valve in said fresh liquid line;

said control system being operative to minimize fresh liquid consumption by said pump; and wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

41. A control system in accordance with claim 40 wherein:

one of said sensors comprises a power input sensor connected in the current leads to said motor and supplying power signals to said control device;

said system comprises a speed controller for varying the speed of said motor; and said control device is responsive to said power signals for controlling said speed controller so that said motor is always run at a predetermined nominal output.

42. A control system comprising:

a suction line;

a separator;

a fresh liquid line;

a liquid ring vacuum pump having a suction input coupled to said suction line, an exhaust output coupled to said separator, a liquid input coupled to said fresh liquid line;

a motor mechanically driving said pump;

one or more sensors connected in said system to measure predetermined parameters within said system;

one or more regulating devices connected in said system to vary one or more respective operative characteristics of said system;

a programmable controller having inputs coupled to said one or more sensors and control signal outputs coupled to said one or more regulating devices and to said motor, said programmable controller having stored chronological and logical functions and being responsive to said stored functions and electrical sensing signals generated by said one or more sensors to control the rotating speed and or power output of said motor and for controlling said regulating devices;

one of said sensors comprises a power input sensor connected in the current leads to said motor and supplying power signals to said control device; said system comprises a speed controller for varying the speed of said motor; and said control device is responsive to said power signals for controlling said speed controller so that said motor is always run at a predetermined nominal output and wherein:

one of said regulating devices comprises an electrically actuable second valve connected in said suction line, said second valve being controlled by said control device to bleed air into said suction line in accordance with a predetermined pressure limit to regulate air input in said suction line to prevent cavitation in the liquid ring in dependence on the temperature in said exhaust line and pressure in said suction line.

* * * * *